US010314345B2

(12) United States Patent
Lambertz

(10) Patent No.: US 10,314,345 B2
(45) **Date of Patent: *Jun. 11, 2019**

(54) ARTICLE OF SPORTS CLOTHING

(71) Applicant: X-Technology Swiss Gmbh, Wollerau (CH)

(72) Inventor: Bodo W. Lambertz, Pfaffikon (CH)

( * ) Notice: Subject to any disclaimer, the term of this patent is extended or adjusted under 35 U.S.C. 154(b) by 226 days.

This patent is subject to a terminal disclaimer.

(21) Appl. No.: 15/358,466

(22) Filed: Nov. 22, 2016

(65) Prior Publication Data

US 2017/0071269 A1 Mar. 16, 2017

Related U.S. Application Data

(63) Continuation of application No. 14/091,078, filed as application No. PCT/DE2012/100158 on May 29, 2012, now Pat. No. 9,532,612.

(30) Foreign Application Priority Data

May 26, 2011 (DE) ..... 20 2011 050 261 U

(51) Int. Cl.

| | |
|---|---|
| ***A41D 13/00*** | (2006.01) |
| ***A41D 1/08*** | (2018.01) |
| ***A41D 27/10*** | (2006.01) |

(52) U.S. Cl.
CPC ..... *A41D 13/0015* (2013.01); *A41D 1/08* (2013.01); *A41D 27/10* (2013.01); *A41D 2400/38* (2013.01); *A41D 2600/10* (2013.01)

(58) Field of Classification Search
CPC ..... A41D 13/0015; A41D 27/10; A41D 1/08; A41D 2600/10
USPC ..... 2/172, 195.1–195.5, 79, 113–115
See application file for complete search history.

(56) References Cited

U.S. PATENT DOCUMENTS

| | | | | |
|---|---|---|---|---|
| 9,532,612 | B2 * | 1/2017 | Lambertz | A41D 13/0015 |
| 2010/0130903 | A1 * | 5/2010 | Rock | A61F 13/06 602/62 |

* cited by examiner

*Primary Examiner* — Katherine M Moran
(74) *Attorney, Agent, or Firm* — Olson & Cepuritis, Ltd.

(57) ABSTRACT

The invention relates to an article of sports clothing (10) for wearing next to the skin, comprising at least on base basic zone of elastically expandable textile fabric and at least on compression section (1, 2, 4, 5, 6, 11) comprising means for compression, which are formed by ridges that are provided on the face of the textile fabric facing towards the skin. The compression sections (1, 2, 4, 5, 6, 11) are arranged asymmetrically in relation to the body halves, divided into the sections provided for the trunk (20) and/or the upper and/or lower extremities (21, 22, 23, 24).

16 Claims, 2 Drawing Sheets

ARTICLE OF SPORTS CLOTHING

RELATED APPLICATION

Figure 1:
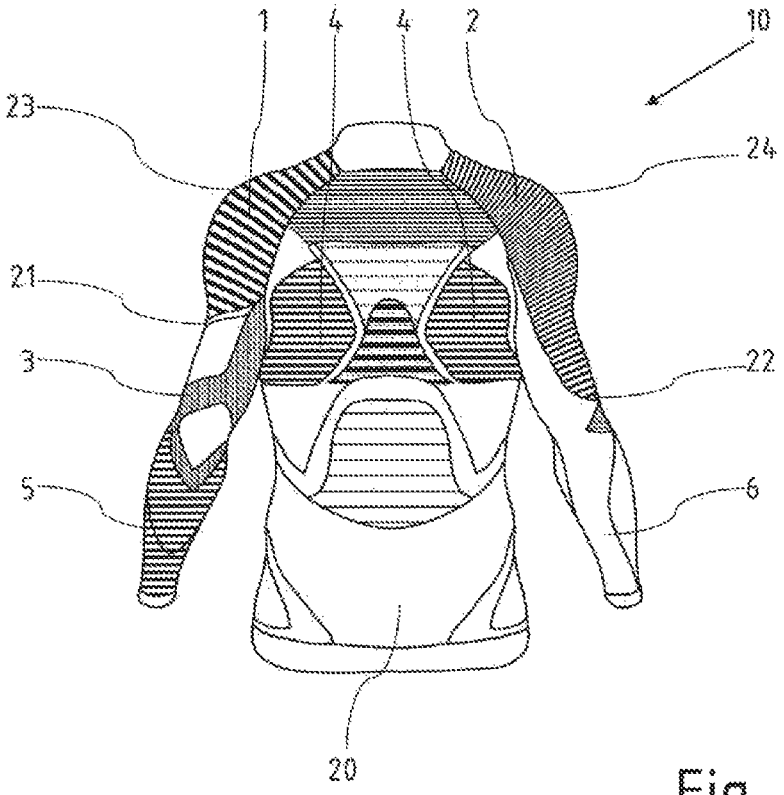

This application is a continuation of application Ser. No. U.S. Ser. No. 14/091,078 filed Mar. 24, 2014, now U.S. Pat. No. 9,532,612, issued Jan. 3, 2017, which was a national stage filing of International Application Serial No. PCT/DE2012/100158 filed May 29, 2012 which claims priority to German Application No. 202011050261.9 filed May 26, 2011, all of which are incorporated herein by reference.

The invention relates to an article of sports clothing for wearing next to the skin, comprising at least one base fabric section of elastically expandable textile fabric and at least one compression section, which has compression means that are formed of ridges provided on the surface of the textile fabric facing towards the skin.

One such article of sports clothing is known from PCT/WO2010/046130. This promotes the circulation of the blood and the stabilization of the musculature. Partial compression is a type of compression which, in comparison with flat compression, exerts pressure on the skin by means of ridges. The ridges are formed by areas of the textile fabric that have a greater thickness than the base fabric or are reinforced by other supplements to the base fabric, and which project correspondingly higher. Because of the elasticity of the base fabric, the edges of the ridges are pressed against the surface of the skin, while the areas of skin located between them are not compressed and, in any event, a very loose contact of the base fabric with the skin is present. Ideally, the base fabric is tightened between the ridges and lifted off the skin. A better cooling of the body can thereby be ensured, since the sweat in the areas between the ridges can evaporate directly on the skin.

The known article of sports clothing has proven its value for general and all-round muscular exertion but, because of the high external stressing of the entire musculature covered with the article of clothing by the compression sections, however, it is not equally well suited for all types of stressing and types of sports.

The task of the present invention is to present a further development of the known article of sports clothing in order to provide an optimal support, particularly upon typically asymmetrical motion sequences.

The solution is provided by an article of sports clothing with the characteristics of claim 1.

The object of the invention is an article of clothing that has different types of compression—that is to say, flat and partial, strong and weak—at the same time. The structures in the sections can be ribbed to different thicknesses, and thus have more or less densely positioned ribs. The intermediate spaces between the individual ribs can likewise have different widths. In certain sections, the material between the ribs can be thinner in order to additionally improve the radiation of the body heat or the evaporation of sweat.

The different types of compression are formed over different sections on the body. The sections are positioned asymmetrically, most particularly in the area of the arms and legs. It is worn in all types of sports that bring about an asymmetrical stressing of the body, such as in golf, for example.

During golfing, for example, it is necessary to have a guiding arm and a swinging arm. In order to be able to carry out the golf swing optimally, the sequence of motion must be extremely precise and even. The asymmetrically positioned compression sections help to carry out the swing optimally, most particularly in the arms and legs since, depending on the stressing of the muscle group covered with the section in the article of sports clothing, they support, heat, or cool the musculature.

It is thereby provided, in accordance with the invention, to generally compress those muscle parts that serve to guide and give direction more strongly, since the vibration of the muscle is also reduced by the one section or the several sections with greater compression. On the other hand, the more highly stressed muscle parts are, in accordance with the invention, compressed less strongly. In the latter case, on the other hand, the aspect of the facilitated and accelerated discharge of heat and moisture from the skin into the environment is more prominent.

In the example of golfing, this means that the article of sports clothing, which is preferably formed as a long-sleeved shirt and is adjusted for a right-hander, has half sections with strong compression in the area of the so-called guiding arm on the shoulder and the upper arm in the left body. On the side of the striking arm in a right-handed person, on the other hand, which is normally on the right, sections are provided in which the musculature is less greatly stressed with the compression means.

These functions can, of course, be adjusted to the most varying requirements, depending on the type of sports with asymmetrical stressing, such as tennis, ice hockey, bowling, baseball, handball, billiards, etc., for example.

Figure 2:
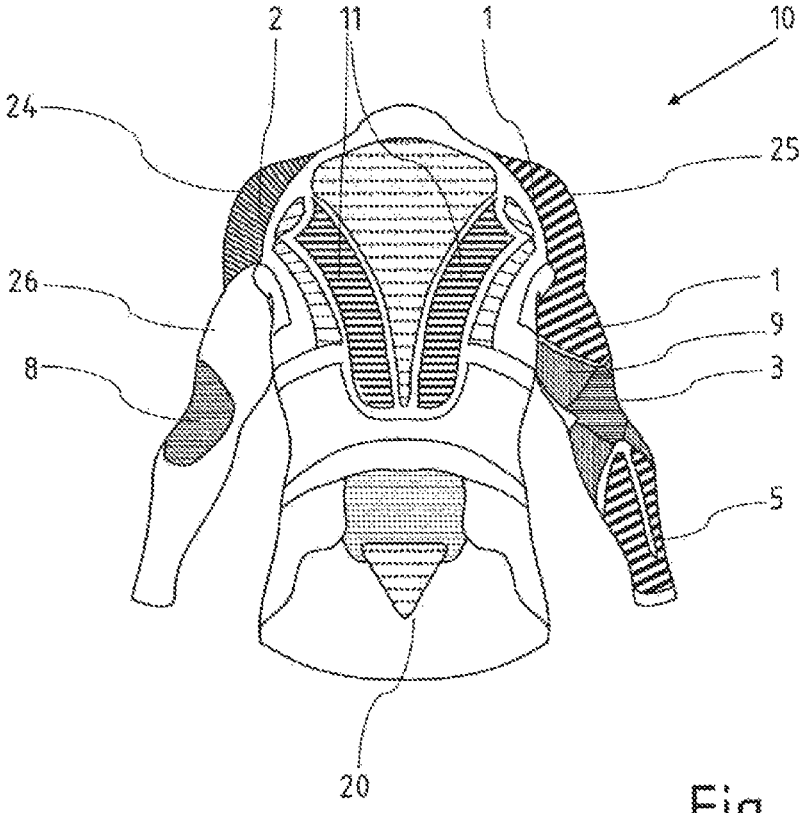

The invention is explained in further detail in the following in relation to the diagrams. In individual terms, the figures depict the following:

FIG. 1: A shirt formed in accordance with the invention in a frontal view, and FIG. 2: The shirt in a view from behind.

FIG. 1 depicts, in a frontal view, an article of sports clothing 10 formed as a shirt with long sleeves. In this, the trunk is numbered 20, the arms are numbered 21, 22, and the shoulders are numbered 23, 24.

Sections 1, 2, 3, 4, 5 are distributed over the article of sports clothing. The asymmetrical formation of sections 1, 2, 5, 6 is particularly essential to the invention. The formation of the specific sections is as follows:

Section 1 in the area of the right shoulder 23 and of the right upper arm 21:

Partial compression with fine knitting on the upper arm 21 and shoulder 23.

Ridges at a greater distance and fine knitting in the intermediate spaces.

Function: Produces a partial compression over the ridges. In the intermediate spaces, sweat can evaporate on the skin. Heat can be radiated through the finely knit structure.

Section 2, in the area of the left shoulder 24 and the left upper arm 26:

Description: Partial compression on the shoulder 24.

Texture: Ridges with slight distance.

Function: Produces a partial compression through the ridges. Sweat on the skin can evaporate in the intermediate spaces.

Section 5 on the right forearm:

Description: Partial compression with fine knitting on the forearm.

Texture: Ridges at a greater distance and fine knitting in the intermediate spaces.

Function: Produces a partial compression over the ridges. Sweat on the skin can evaporate in the intermediate spaces. Heat can be radiated through the finely knit structure.

Section 6 on the left forearm:

Texture: Only base fabric, no compression.

Section 4 in the chest area and section 11 in the back area likewise serve for the compression of muscle parts, but symmetrically, however.

Section 4:

Description: Partial compression with fine knitting in the chest area.

Texture: Ridges with greater distance and fine knitting in the intermediate spaces.

Function: Produces a partial compression over the ridges. Sweat on the skin can evaporate in the intermediate spaces. Heat can be radiated through the finely knit structure.

Section 11:

Description: Partial compression with fine knitting on the shoulder blade.

Texture: Ridges with greater distance and finely knit in the intermediate spaces.

Function: Produces a partial compression over the ridges. Sweat on the skin can evaporate in the intermediate spaces. Heat can be radiated through the finely knit structure.

The following additional functional sections are additionally present:

Section 3 on the right elbow joint:

Description: X-cross bandage.

Texture: X-shaped bandage around the elbow joint.

Function: Stabilizes the joint and supports the ligaments and tendons in the joint.

Sections 8, 9 on the elbow joints:

Description: Expansion ribs

Texture: Rib-shaped structure

Function: Expanding ribs keep the insulating intermediate spaces upright, even in the bent condition.

The invention claimed is:

1. A sport compression shirt with sleeves having a first sleeve and a second sleeve adapted to cover the arms of a wearer, a first shoulder region and a second shoulder region adapted to cover the shoulders of the wearer, and a trunk region adapted to cover a trunk of the wearer comprising:

an elastically expandable textile base fabric having an interior surface for contacting skin when the shirt is worn, and an exterior surface;

a plurality of fabric compression sections on the interior surface of the base fabric distributed over portions of the trunk region, the first shoulder region, the second shoulder region, the first sleeve, and the second sleeve thereof; the compression sections comprising a plurality of spaced ridges configured to contact and exert pressure on the skin when the shirt is worn;

wherein, the compression sections distributed over the first shoulder region are arranged asymmetrically to the compression sections of the second shoulder region to provide a different level of compression in the first shoulder region relative to the second shoulder region when the shirt is worn, and the compression sections distributed over the first sleeve are arranged asymmetrically to the compression sections of the second sleeve to provide a different level of compression in the first sleeve relative to the second sleeve when the shirt is worn;

wherein at least one of the compression sections in the first shoulder region is arranged in a pattern which is different from the pattern of at least one of the compression sections in the second shoulder region and the ridges in at least one of the compression sections in the first shoulder region are arranged with different spacing and have a different coefficient of elasticity relative to the ridges in at least one of the compression sections in the second shoulder region; and at least one of the compression sections in the first sleeve is arranged in a pattern which is different from the pattern of at least one of the compression sections in the second sleeve and the ridges in at least one of the compression sections in the first sleeve region are arranged with different spacing and have a different coefficient of elasticity relative to the ridges in at least one of the compression sections in the second sleeve.

2. The sport compression shirt of claim 1, wherein the spacing of the ridges of the compression sections distributed over the first shoulder region and the first sleeve are arranged in the same pattern and have the same coefficient of elasticity relative each other and the spacing of the ridges of the compression sections distributed over the second shoulder region and the second sleeve are arranged in the same pattern and have the same coefficient of elasticity relative each other with the spacing of the ridges and coefficient of elasticity of the compression sections of the first shoulder region and first sleeve are different from the spacing of the ridges and coefficient of elasticity of the compression sections of the second shoulder region and the second sleeve.

3. The sport compression shirt of claim 1, wherein each of the first sleeve and second sleeve comprises an upper arm region, a forearm region and an elbow region there between.

4. The sport compression shirt of claim 3, wherein a compression section is provided in a forearm region of the first sleeve and the forearm region of the second sleeve does not include a compression section.

5. The sport compression shirt of claim 3, wherein at least one of the first and second sleeves comprises an X-shaped section of crossed bands at the elbow region.

6. The sport compression shirt of claim 1, wherein the trunk region comprises a symmetrically arranged plurality of compression sections.

7. The sport compression shirt of claim 1, wherein the plurality of spaced ridges are composed of or coated with a material that is compressible and which expand in a delayed manner relative to the base fabric.

8. The sport compression shirt of claim 1, wherein the plurality of spaced ridges have a thickness greater than a thickness of the base fabric.

9. A sport compression shirt with sleeves having a first shoulder region and a second shoulder region adapted to cover the shoulders of the wearer, a first sleeve extending from the first shoulder region and adapted to cover at least a first upper arm of the wearer and a second sleeve extending from the second shoulder region and adapted to cover at least a second upper arm of the wearer, and a trunk region adapted to cover the trunk of the wearer comprising:

an elastically expandable textile base fabric having an interior surface for contacting skin when the shirt is worn, and an exterior surface;

a plurality of fabric compression sections on the interior surface of the base fabric distributed over portions of the trunk region, the first shoulder region and the first sleeve and the second shoulder region and the second sleeve thereof;

the compression sections comprising a plurality of spaced ridges configured to contact and exert pressure on the skin when the shirt is worn;

wherein, the compression sections distributed over the first shoulder region and the first sleeve are arranged asymmetrically in relation to the compression sections distributed over the second shoulder region and the second sleeve to provide a different level of compression to the first shoulder region of the first sleeve relative to the second shoulder region of the second sleeve when the shirt is worn.

10. The sport compression shirt of claim 9, wherein the plurality of spaced ridges of the compression sections distributed over the first shoulder region of the first sleeve are arranged with different spacing and have a different coefficient of elasticity relative to the plurality of spaced ridges of the compression sections distributed over the second shoulder region of the second sleeve.

11. The sport compression shirt of claim 9, wherein each of the first sleeve and second sleeve comprises an upper arm region, a forearm region and an elbow region therebetween.

12. The sport compression shirt of claim 11, wherein a compression section is provided in a forearm region of the first sleeve and the forearm region of the second sleeve does not include a compression section.

13. The sport compression shirt of claim 11, wherein at least one of the first and second sleeves comprises an X-shaped section of crossed bands at the elbow region.

14. The sport compression shirt of claim 9, wherein the trunk region comprises a symmetrically arranged plurality of compression sections.

15. The sport compression shirt of claim 9 wherein the plurality of spaced ridges are composed of or coated with a material that is compressible and which expand in a delayed manner relative to the base fabric.

16. The sport compression shirt of claim 9, wherein the plurality of spaced ridges have a thickness greater than a thickness of the base fabric.

* * * * *